US006125989A

United States Patent [19]

Oden

[11] Patent Number: 6,125,989

[45] **Date of Patent: *Oct. 3, 2000**

[54] TAMPER-RESISTANT VENDING MACHINE

[75] Inventor: Kenneth W. Oden, Charles Town, W. Va.

[73] Assignee: Royal Vendors, Inc., Kearneysville, W. Va.

[ * ] Notice: This patent is subject to a terminal disclaimer.

[21] Appl. No.: 09/110,394

[22] Filed: Jul. 7, 1998

Related U.S. Application Data

[63] Continuation of application No. 08/790,864, Feb. 3, 1997, Pat. No. 5,791,450, which is a continuation of application No. 08/262,053, Jun. 17, 1994, Pat. No. 5,601,177.

[51] Int. Cl.[7] ..... G07F 1/04

[52] U.S. Cl. ..... 194/348; 194/350

[58] Field of Search ..... 194/344, 347, 194/348, 349, 350; 232/15, 16

[56] References Cited

U.S. PATENT DOCUMENTS

| | | | |
|---|---|---|---|
| 829,265 | 9/1906 | Goeb . | |
| 2,104,505 | 1/1938 | Patche | 194/347 X |
| 2,865,561 | 12/1958 | Rosapepe . | |
| 3,083,896 | 4/1963 | Cairelli et al. | 232/15 |
| 4,037,700 | 7/1977 | Heraty . | |
| 4,051,938 | 10/1977 | Brown . | |
| 4,177,889 | 12/1979 | Adams et al. . | |
| 4,230,213 | 10/1980 | Spring . | |
| 4,306,644 | 12/1981 | Rockola . | |
| 4,326,620 | 4/1982 | Felix et al. | 194/350 X |
| 4,399,903 | 8/1983 | McDonald . | |
| 4,821,863 | 4/1989 | Okada | 194/350 X |
| 5,027,937 | 7/1991 | Parish et al. | 194/348 |
| 5,176,238 | 1/1993 | Deglau | 194/344 X |
| 5,193,862 | 3/1993 | Oden . | |
| 5,226,521 | 7/1993 | Oden | 194/350 |

FOREIGN PATENT DOCUMENTS

| | | |
|---|---|---|
| 85 109 753 | 3/1986 | European Pat. Off. . |
| 88 402 903 | 5/1989 | European Pat. Off. . |
| 37 02 611 | 8/1988 | Germany . |
| 2 202 983 | 10/1988 | United Kingdom . |

*Primary Examiner*—F. J. Bartuska
*Attorney, Agent, or Firm*—Jacobson, Price, Holman & Stern, PLLC

[57] ABSTRACT

A tamper-resistant door for a vending machine includes a conventionally-positioned product delivery port, a cash box vault positioned adjacent the delivery port for receiving a cash box, a coin return slot positioned at an upper corner of the delivery port, and a coin changer of conventional design positioned over the delivery port and the cash box. A changer vault partially encloses the coin changer. The cash box vault (and the cash box placed therein) are relocated away from their conventional position on the non-hinged side of the main door to a location adjacent the product delivery port on the hinged side of the door, while the coin changer is relocated away from its prior art position adjacent the non-hinged side of the main door to a central location above the product delivery port and the cash box vault. An elongated coin chute connects a coin slot with the coin inlet of the coin changer. A first section of the coin chute is in communication with the coin slot. It incorporates both a longitudinal drop at its inlet end and a sideways bend adjacent its outlet end, and is provided along its bottom with a plurality of drainage slots. A second section of the coin chute is in communication with the coin inlet of the coin changer, and angles downwardly to provide a vertical drop between the outlet of the first section and the inlet of the coin changer.

18 Claims, 3 Drawing Sheets

TAMPER-RESISTANT VENDING MACHINE

This is a continuation of U.S. application Ser. No. 08/790,864, filed Feb. 3, 1997, now U.S. Pat. No. 5,791,450 which is a continuation of U.S. application Ser. No. 08/262,053, filed Jun. 17, 1994, now U.S. Pat. No. 5,601,177.

BACKGROUND OF THE INVENTION

1. Field of the Invention

The present invention relates to a tamper-resistant vending machine. More specifically, the invention relates to a coin-operated vending machine in which the coin changer and cash box are moved from their conventional positions and the coin inlet chute is reconfigured to render the vending machine tamper-resistant.

2. Related Art

Vending machines and other coin-operated devices employ coin acceptor and coin acceptor/pay-out devices, such as coin changers for the convenience of users who do not have exact change. These coin acceptor and coin acceptor/pay-out devices employ electronic coin validators and other electronic mechanisms which are susceptible to a form of tampering known as "salting," that is, pouring a salt water solution into the device in order to short out its circuitry and cause either "jackpotting," that is, the dispensing of all the coins in the coin acceptor, or a free vend.

Also, the coin changers are conventionally located in the main door on the side opposite the hinges, with the cash box positioned underneath to receive coins discharged by the coin changer. Vandals will pry the bottom of the main door of vending machines and steal the cash box, and then squirt a salt water solution in through the coin insert slot to cause jackpotting or set up a free vend.

Devices to prevent tampering with coin-operated machines and their coin acceptors are numerous. U.S. Pat. No. 829,265 to Goeb, U.S. Pat. No. 2,865,561 to Rosapepe, U.S. Pat. No. 5,027,937 to Parish et al., U.S. Pat. No. 4,230,213 to Spring, and U.S. Pat. No. 4,306,644 to Rockola et al., are illustrative, and are discussed at length in my U.S. Pat. No. 5,226,521, which is incorporated herein by reference in its entirety. My U.S. Pat. No. 5,226,521 addresses the problem of "salting" by providing a protective jacket for the coin changer, the jacket being made from an elastic material and conforming substantially to the configuration of the coin changer.

However, none of these devices addresses the problem of theft of the coin box. Typically, this problem is addressed by providing some type of vault for the coin box.

For example, U.S. Pat. No. 4,399,903 to McDonald discloses an enlarged coin box for a product dispenser that utilizes all of the available space in the dispenser.

U.S. Pat. No. 4,177,889 to Adams et al. disclose a money box and vault including a housing with a hollow chamber for receiving a lockable coin box. The coin box has inner and outer relatively rotatable cylindrical housings with coin receiving openings formed therein. The money box and vault are for use in the collection and transportation of money from coin operated machines such as vending machines, and are not adapted to use in vending machines themselves.

U.S. Pat. No. 4,051,938 to Brown discloses a coin box for a vending machine mounted inside a building wall to protect it from vandalism and burglary. Because it is designed for use behind a building wall, it is not adapted for use in free-standing vending machines.

U.S. Pat. No. 4,037,700 to Heraty discloses a hollow post vault for a coin box. The coin box is placed inside the post vault through a bottom port and locked in place above the port by a releasable support member locked inside the post. The post vault is free-standing. Although such a freestanding arrangement is suitable for use with a coin mechanism operating an appliance such as a vacuum machine at an automotive service station, it is unsuitable for use in vending machines.

Although the patents to McDonald, Adams et al., Brown, and Heraty provide some security against vandalism to the cash box, they are not necessarily adapted for use in vending machines, and provide no solution to the problem of "salting." In fact, the prior art treats the problems of "salting" and cash box theft separately, and does not provide any mechanism which addresses both problems simultaneously.

It is the solution to these and other problems to which the present invention is directed.

SUMMARY OF THE INVENTION

It is therefore a primary object of the present invention to provide a vending machine which, by the positioning and configuration of its coin changer and cash box, is rendered tamper-resistant with respect both to the coin changer and the cash box.

This and other objects of the invention are achieved by the provision of a tamper-resistant door for an enclosure such as a vending machine. The door includes a conventionally-positioned product delivery port, a cash box vault positioned adjacent the delivery port for receiving a cash box, a coin return slot positioned at an upper corner of the delivery port, and a coin changer positioned over the delivery port and the cash box. The coin changer, which is of a conventional variety, includes an inlet for receiving coins, a first outlet in communication with the coin return slot for returning change through the delivery port, and a second outlet in communication with an opening in the cash box vault for depositing change into a cash box in the cash box vault. A changer vault encloses at least the front, top, and side faces of the coin changer.

An elongated coin chute connects a coin slot with the coin inlet of the coin changer. The coin chute has a first section in communication with the coin slot and a second section in communication with the coin inlet of the coin changer. The first section incorporates both a longitudinal drop at its inlet end and a sideways bend adjacent its outlet end, and is provided along its bottom with a plurality of drainage slots. The second section angles downwardly to provide a vertical drop between the outlet of the first section and the inlet of the coin changer.

The cash box vault (and the cash box placed therein) are relocated away from their conventional prior art position on the non-hinged side of the main door to a location adjacent the product delivery port on the hinged side of the door, while the coin changer is relocated away from its conventional prior art position adjacent the non-hinged side of the main door to a central location above the product delivery port and the cash box vault. The new positions of the cash box vault, cash box, and coin changer make it more difficult for a vandal to access them, even if he should succeed in partially prying open the main door.

The slots and sideways bend in the first section of the coin chute are sized and configured to permit coins inserted into the coin slot to roll freely through the first section into the second section, and thence down into the coin inlet of the coin changer. The curvature of the sideways bend will slow the flow of any liquid poured into the coin slot, while the drainage slots permit the liquid to drain out before reaching the second section.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
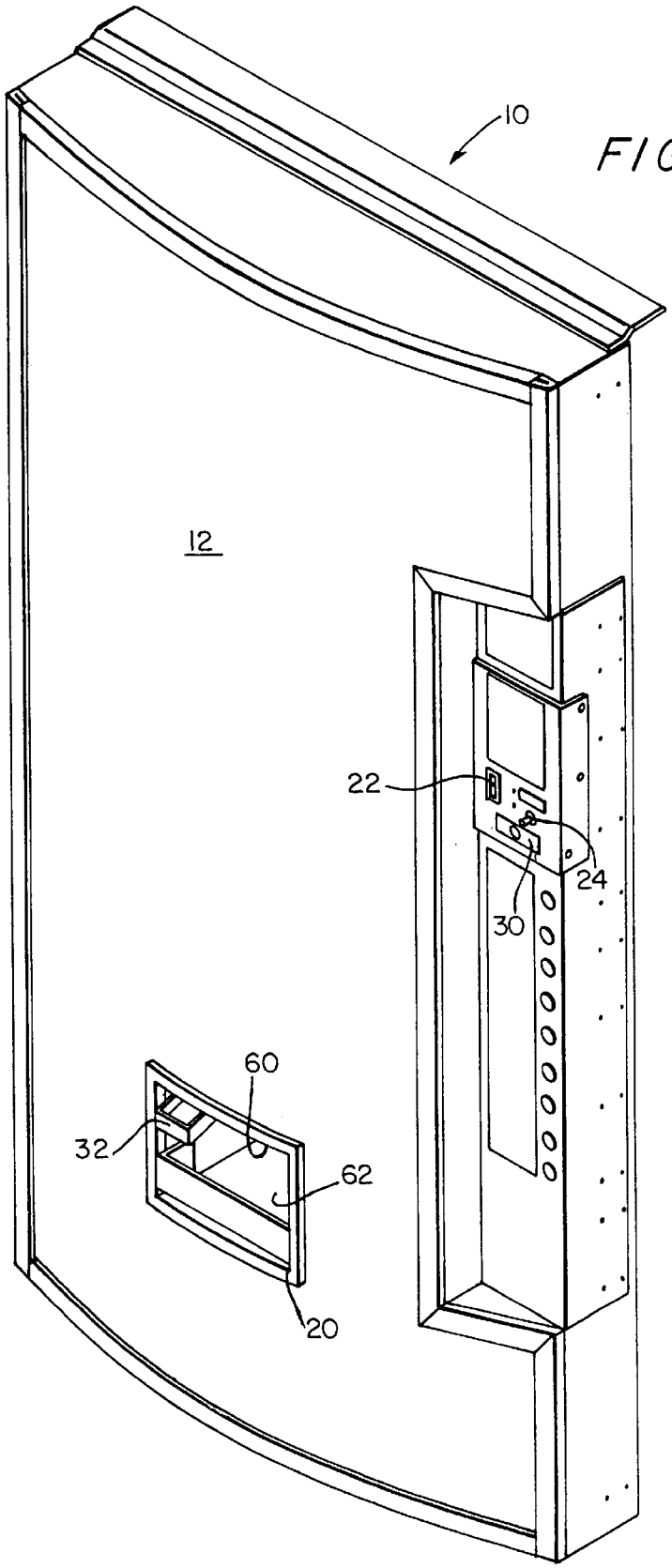
FIG. 1 is a front perspective view of the main door of a vending machine incorporating the tamper-resistant features according to the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Referring now to FIG. 1, there is shown the main door 10 of a vending machine incorporating the tamper-resistant features according to the present invention. Main door 10 incudes a front face 12 having a conventionally-positioned product delivery port 20, a conventionally-positioned coin slot 22, and a conventionally-positioned coin return control 24. By conventionally-positioned, it is meant that product delivery port 20, coin slot 22, and coin return control 24 are positioned as they generally are in prior art vending machines. Thus, product delivery port 20 is approximately centered in the lower half of front face 12; and coin slot 22 and coin return control 24 are located adjacent each other in the upper half of front face 12 along the edge of main door 10 which is opposite the hinges (not shown).

Front face 12 also includes a handle 30 of an anti-theft latch mechanism as disclosed in U.S. Pat. No. 5,193,862 to Oden, which is incorporated herein by reference in its entirety. Handle 30 is positioned immediately below coin slot 22 and coin return control 24. A coin return cup 32 is positioned within product delivery port 20, preferably at an upper corner thereof.

Figure 2:
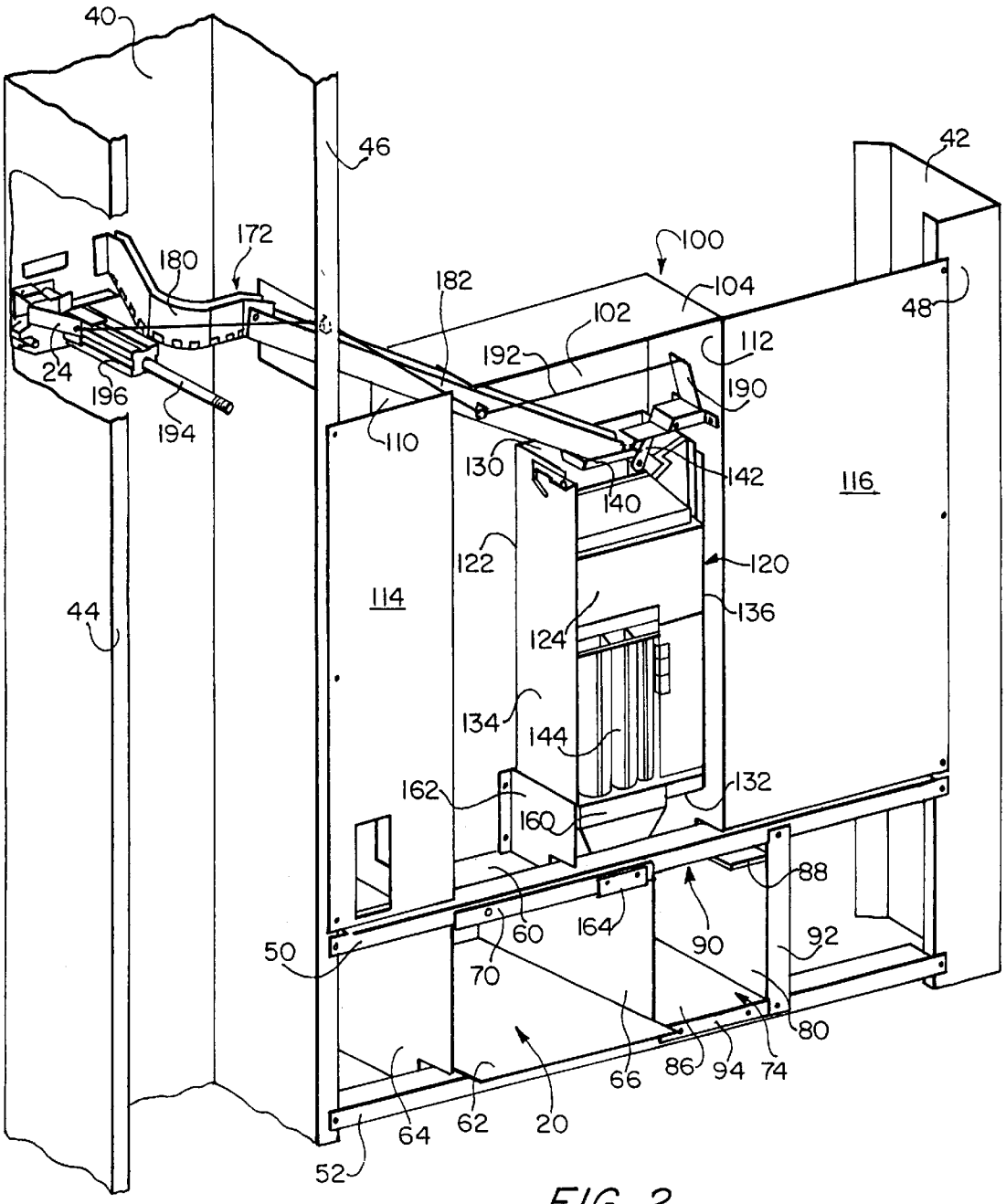
FIG. 2 is a rear perspective view of the tamper resistant features of the main door of FIG. 1.

Referring now to FIG. 2, main door 10 includes in its rear face (as viewed when main door 10 is in its closed position) left and right (as viewed from the rear) side columns 40 and 42. Left side column 40 is generally U-shaped, with left and right flanges 44 and 46 formed at the edges of its open (rear) side. Right side column 42 is provided with a rear face 48 which is coplanar with left and right flanges 44 and 46. Upper and lower, parallel, spaced-apart braces 50 and 52 are attached to and extend between right flange 46 of left side column 40 and rear face 48 of right side column 42.

Delivery port 20 is positioned between upper and lower braces 50 and 52. Delivery port 20 includes upper and lower walls 60 and 62 and opposed left and right side walls 64 and 66. A flange 70 is provided at the rear edge of upper wall 60 for attaching delivery port 20 to upper brace 50. Lower wall 62 extends outwardly of and is supported by lower brace 52.

A cash box vault 74 is positioned immediately adjacent delivery port 20 on the hinge side of main door 10 for receiving a cash box (not shown). This position contrasts from the conventional location, which is along the non-hinged side of the main door, spaced downwardly from the coin slot and coin return control.

Cash box vault 74 includes side wall 66 in common with delivery port 20, a right side wall 80 opposite common side wall 66, a front wall (not shown), a bottom wall 86, and a top wall 88 having an opening 90 therein. A side flange 92 is formed at the rear edge of right side wall 80 and extends between upper and lower braces 50 and 52 for attaching cash box vault 74 to upper and lower braces 50 and 52. Also, a lower flange 94 is formed at the rear edge of bottom wall 86 for attaching cash box vault 74 to lower brace 52.

A coin changer vault 100 extends above upper brace 50 between right flange 46 of left side column 40 and rear face 48 of right side column 42. Coin changer vault 100 includes a front face 102, a top face 104, and opposed side faces 110 and 112. Left and right rear flaps 114 and 116 extend perpendicularly outwardly from the open (rear) edges of side faces 110 and 112, respectively, for attaching coin changer vault 100 to right flange 46 of left column 40 and to rear face 48 of right side column 42 above upper brace 50.

A coin changer 120 is positioned in and partially enclosed by coin changer vault 100 over delivery port 20 and cash box 74. Coin changer 120 can be any conventional vending machine coin changer, such as one of the 9300 Series coin changers made by Coin Acceptors, Inc. of St. Louis, Mo. Coin changer 120 includes opposed front and back faces 122 and 124, opposed top and bottom faces 130 and 132, and opposed left and right side faces 134 and 136. A coin inlet 140 is provided at top face 130 for receiving coins. A coin return lever 142 adjacent inlet 140 can be activated to return coins received through inlet 140, in a manner to be described hereinafter. A plurality of columns 144 are positioned below inlet 140 for holding sorted coins of different denominations.

Figure 3:
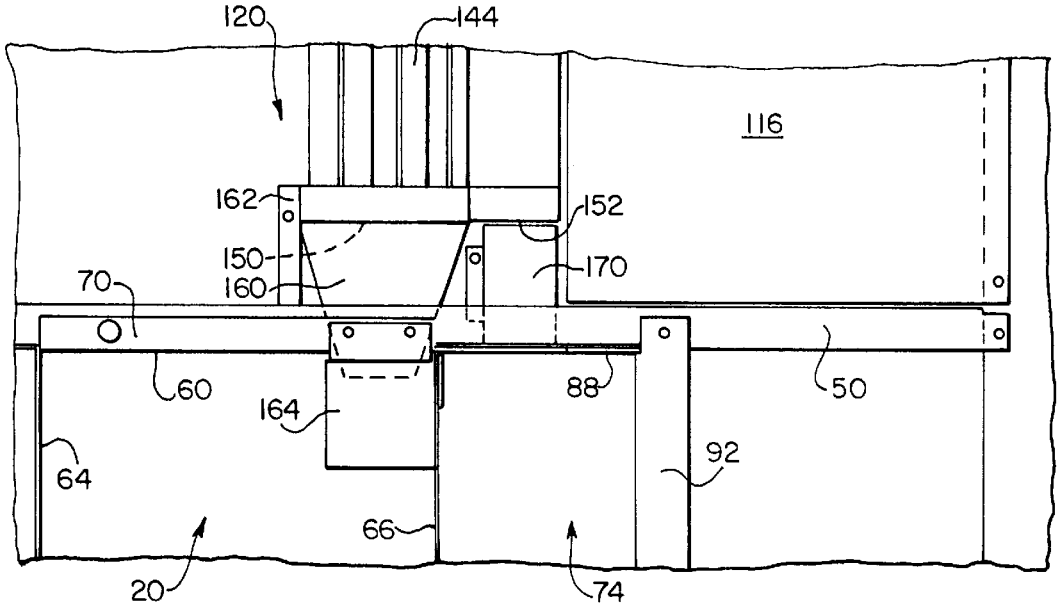
FIG. 3 is a partial rear plan view of the tamper resistant features shown in FIG. 2.

As best shown in FIG. 3, coin changer 120 also includes a first outlet 150 under columns 144 for expelling coins from columns 144 for the purpose of making change and for returning coins when a purchase is voided; and a second outlet 152 in bottom face 132 adjacent the first outlet for depositing coins to the coin box. Coin changer 120 is positioned in coin changer vault 100 with its first outlet 150 over and spaced from the opening in upper wall 60 of delivery port 20 and with its second outlet 152 positioned over and spaced from opening 90 in top wall 88 of cash box vault 74. This position contrasts from the conventional location, which is interposed between the coin slot and the conventional position of the cash box vault.

A coin hopper 160 is interposed between first outlet 150 of coin changer 120 and the opening in upper wall 60 of product delivery port 20, with its inlet in communication with first outlet 150 of coin changer 120. A bracket 162 attaches coin hopper 160 to front face 102 of changer vault 100.

As best seen in FIG. 3, a coin return chute 164 is positioned under and in communication with the outlet of coin hopper 160. The front end of coin return chute 164 defines coin return cup 32 (see FIG. 1). Change or coins to be returned from a voided purchase is thus channeled from coin changer 120 to coin return cup 32.

Referring now to FIG. 3, a coin box chute 170 is interposed between second outlet 152 of coin changer 120 and opening 90 in the top 88 of cash box vault 74, with its inlet in communication with second outlet 152 of coin changer 120 and its outlet in communication with opening 90 in top 88 of cash box vault 74. Coins can thus be deposited to the coin box from coin changer 120.

Figure 4:
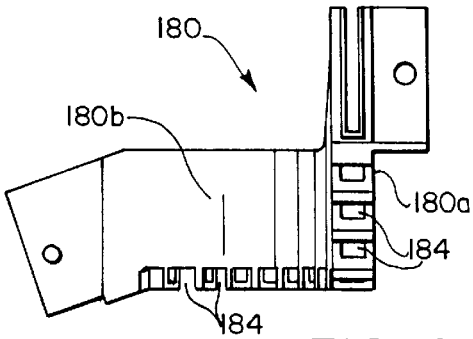
FIG. 4 is a front plan view of the first section of the coin chute shown in FIG. 2.
Figure 5:
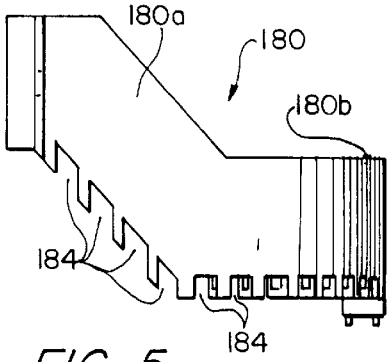
FIG. 5 is a side plan view of the first section of the coin chute shown in FIG. 2.
Figure 6:
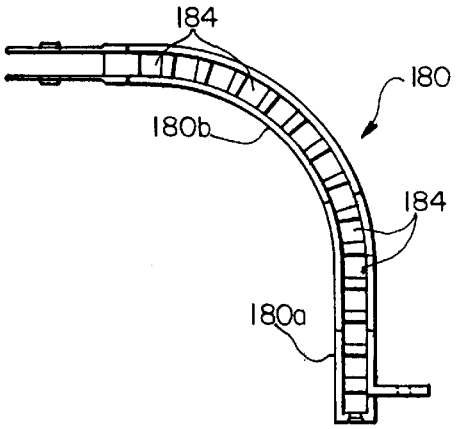
FIG. 6 is a top plan view of the first section of the coin chute shown in FIG. 2.

As shown in FIG. 2 and 4–6, an elongate coin chute 172 extends between coin slot 22 and inlet 140 of coin changer 120. Coin chute 172 includes a first section 180 having an inlet in communication with coin slot 22 and a second section 182 having an outlet in communication with inlet 140 of coin changer 120. As best shown in FIGS. 4–6, first section 180 incorporates both a longitudinal drop 180*a* at its inlet end and a sideways bend 180*b* adjacent its outlet end. In addition, first section 180 is provided along its bottom with a plurality of drainage slots 184. Second section 182 is generally linear, but angles downwardly to provide a vertical drop between the outlet of first section 180 and inlet 140 of coin changer 120.

Slots 184 and sideways bend 180*b* are sized and configured to permit coins inserted into coin slot 22 to roll freely through first section 180 into second section 182, and thence down into coin inlet 140 of coin changer 120. However, if a liquid is poured into coin slot 22, the curvature of sideways bend 180*b* will slow the flow of the liquid, and slots 184 will permit the liquid to drain out (into a receptacle below, not shown) before reaching second section 182. Efforts to tamper with the vending machine by "salting" can thus be averted.

Referring again to FIG. 2, an operating lever 190 is pivotably attached to side wall 112 of coin box vault 100. A taut wire 192 extends between coin return control 24 and operating lever 190. Thus, when coin return control 24 is operated, taut wire 192 pulls on operating lever 190, causing its lower edge to depress coin return lever 142.

A stud 194 and stud housing 196 of the anti-theft latch mechanism of U.S. Pat. No. 5,193,862 are provided adjacent first section 180 of coin chute 172. The anti-theft latch mechanism makes it extremely difficult for vandals to open main door 10. Further, relocation of cash box vault 74 (and the cash box placed therein) away from the non-hinged side of main door 10 (to a location adjacent the product delivery port on the hinged side of the door), and relocation of coin changer 120 away from the non-hinged side of main door 10 (to a central location above product delivery port 20 and cash box vault 74) make it more difficult for a vandal to access the cash box vault and coin changer 120, even if he should succeed in partially prying open main door 10.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A tamper-resistant door for an enclosure such as a vending machine, said door including a front face having upper and lower halves and comprising:

a product delivery port positioned in said lower half of said front face, said product delivery port including an upper wall;

a cash box vault positioned adjacent said delivery port for receiving a cash box, said cash box vault including a top having an opening therein;

a coin return chute having a coin discharge, said coin discharge being positioned in said product delivery port;

a coin changer positioned centrally of said door spaced from the edges thereof and over said product delivery port, said coin changer having opposed front and back faces, opposed top and bottom faces, and opposed side faces, an inlet for receiving coins, a first outlet in communication with said coin return chute for returning change through said delivery port, and a second outlet in communication with said opening in said cash box vault for depositing change into a cash box in said cash box vault; and a changer vault enclosing at least said front, top, and side faces of said coin changer.

2. The door of claim 1, further comprising:

a coin slot positioned in said upper half of said front face; and a coin chute connecting said coin slot with said inlet of said coin changer, said coin chute having drainage means therein for discharging material introduced into said coin slot into a lower area of said door in which it cannot contact said coin changer.

3. The door of claim 2, wherein said coin chute includes a sideways bend therein between said coin slot and said inlet of said coin changer.

4. The door of claim 3, wherein said coin chute includes a vertical drop between said coin slot and said sideways bend.

5. The door of claim 3, wherein said coin chute includes a first vertical drop between said coin slot and said sideways bend and a second vertical drop between said sideways bend and said inlet of said coin changer.

6. The door of claim 1, further including a coin hopper interposed between said first outlet of said coin changer and said coin return chute.

7. The door of claim 1, further including a coin box chute interposed between said second outlet of said coin changer and said cash box vault.

8. The door of claim 1, wherein said coin changer includes a coin return lever, and said door further comprises a coin return operator and a linkage operatively connecting said coin return operator with said coin return lever.

9. The door of claim 1, said cash box vault further including closed side and bottom walls.

10. A tamper-resistant door for an enclosure such as a vending machine, said door including a front face having upper and lower halves and comprising:

a product delivery port positioned in said lower half of said front face, said product delivery port including an upper wall;

a coin slot positioned in said upper half of said front face;

a cash box vault positioned adjacent said delivery port for receiving a cash box, said cash box vault including a top having an opening therein;

a coin changer positioned above said delivery port, said coin changer having opposed front and back faces, opposed top and bottom faces, and opposed side faces, an inlet for receiving coins, and an outlet for communication with said opening in said cash box vault for depositing change into a cash box in said cash box vault, wherein said coin changer is positioned in said door spaced from the edges thereof and over said product delivery port;

means for protecting at least three sides of said coin changer; and a coin chute connecting said coin slot with said inlet of said coin changer, said coin chute having an inlet in communication with said coin slot and an outlet in communication with said coin changer, a vertical drop between said inlet and said outlet of said coin chute so that said inlet and said outlet of said coin chute lie in different horizontal planes, a sideways bend between said inlet and said outlet of said coin chute so that said inlet and said outlet of said coin chute lie in different vertical planes, and said coin chute also having drainage means therein for discharging material introduced into said coin slot into a lower area of said door in which it cannot contact said coin changer, and said drainage means and said sideways bend being sized and configured to permit coins inserted into said coin slot to roll freely through said coin chute, and thence down into said inlet of said coin changer.

11. A tamper-resistant door for an enclosure such as a vending machine, said door including a front face having upper and lower halves and comprising:

a product delivery port positioned in said lower half of said front face, said product delivery port including an upper wall;

a coin slot positioned in said upper half of said front face;

a cash box vault positioned adjacent said delivery port for receiving a cash box, said cash box vault including a top having an opening therein;

a coin changer positioned in said door spaced from the edges thereof and above said delivery port, said coin changer having opposed front and back faces, opposed top and bottom faces, and opposed side faces, an inlet for receiving coins, and an outlet for communication with said opening in said cash box vault for depositing change into a cash box in said cash box vault;

means for protecting at least three sides of said coin changer; and a coin chute connecting said coin slot with said inlet of said coin changer, said coin chute having drainage means therein for discharging material introduced into said coin slot into a lower area said door in which it cannot contact said coin changer;

wherein said coin chute includes a first section and a second section each having an inlet and an outlet, said inlet of said first section being in communication with said coin slot, said outlet of said first section being connected to said inlet of said second section, and said outlet of said second section being in communication with said inlet of said coin changer, said first section incorporating a longitudinal drop adjacent said inlet thereof and a sideways bend adjacent said outlet thereof, said second section being generally linear, and angling downwardly to provide a vertical drop between said outlet of first section and said inlet of said coin change; and wherein said drainage means is formed in said first section of said coin chute.

12. A tamper-resistant door for an enclosure such as a vending machine, said door including a front face having upper and lower halves and comprising:

a product delivery port positioned in said lower half of said front face, said product delivery port including an upper wall;

a cash box vault positioned adjacent said delivery port for receiving a cash box, said cash box vault including a top having an opening therein;

a coin return chute having a coin discharge, said coin discharge being positioned in said product delivery port;

a coin changer positioned centrally of said door spaced from the edges thereof and over said product delivery port, said coin changer having opposed front and back faces, opposed top and bottom faces, and opposed side faces, an inlet for receiving coins, a first outlet in communication with said coin return chute for returning change through said delivery port, and a second outlet in communication with said opening in said cash box vault for depositing change into a cash box in said cash box vault; and means for protecting at least three sides of said coin changer.

13. The door of claim 12, further comprising:

a coin slot positioned in said upper half of said front face; and a coin chute connecting said coin slot with said inlet of said coin changer, said coin chute having drainage means therein for discharging material introduced into said coin slot into a lower area said door in which it cannot contact said coin changer.

14. The door of claim 13, wherein said coin chute includes a sideways bend therein between said coin slot and said inlet of said coin changer.

15. The door of claim 14, wherein said coin chute includes a vertical drop between said coin slot and said sideways bend.

16. The door of claim 14, wherein said coin chute includes a first vertical drop between said coin slot and said sideways bend and a second vertical drop between said sideways bend and said inlet of said coin changer.

17. A tamper-resistant door for an enclosure such as a vending machine, said door including a front face having upper and lower halves, a hinged side, and a non-hinged side opposite said hinged side, and comprising:

a product delivery port positioned in said lower half of said front face, said product delivery port including an upper wall;

a cash box vault positioned adjacent said delivery port for receiving a cash box, said cash box vault including a top having an opening therein;

a coin return chute having a coin discharge, said coin discharge being positioned in said product delivery port;

a coin changer positioned in said door spaced from the edges thereof and away from said non-hinged side of said door and over said product delivery port, said coin changer having opposed front and back faces, opposed top and bottom faces, and opposed side faces, an inlet for receiving coins, a first outlet in communication with said coin return chute for returning change through said delivery port, and a second outlet in communication with said opening in said cash box vault for depositing change into a cash box in said cash box vault; and a changer vault enclosing at least said front, top, and side faces of said coin changer.

18. A tamper-resistant door for an enclosure such as a vending machine, said door including a front face having upper and lower halves, a hinged side, and a non-hinged side opposite said hinged side, and comprising:

a product delivery port positioned in said lower half of said front face, said product delivery port including an upper wall;

a cash box vault positioned adjacent said delivery port for receiving a cash box, said cash box vault including a top having an opening therein;

a coin return chute having a coin discharge, said coin discharge being positioned in said product delivery port;

a coin changer positioned in said door spaced from the edges thereof and away from said non-hinged side of said door and over said product delivery port, said coin changer having opposed front and back faces, opposed top and bottom faces, and opposed side faces, an inlet for receiving coins, a first outlet in communication with said coin return chute for returning change through said delivery port, and a second outlet in communication with said opening in said cash box vault for depositing change into a cash box in said cash box vault; and means for protecting at least three sides of said coin changer.

* * * * *